US009336724B2

(12) United States Patent
Jang

(10) Patent No.: US 9,336,724 B2
(45) Date of Patent: May 10, 2016

(54) BACKLIGHT UNIT, METHOD FOR DRIVING THE SAME, AND LIQUID CRYSTAL DISPLAY DEVICE USING THE SAME

(75) Inventor: Hoon Jang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 821 days.

(21) Appl. No.: 12/962,759

(22) Filed: Dec. 8, 2010

(65) Prior Publication Data

US 2011/0157246 A1 Jun. 30, 2011

(30) Foreign Application Priority Data

Dec. 28, 2009 (KR) ..... 10-2009-0131952

(51) Int. Cl.
*G09G 5/00* (2006.01)
*G09G 3/34* (2006.01)
*H05B 33/08* (2006.01)

(52) U.S. Cl.
CPC ..... *G09G 3/3406* (2013.01); *H05B 33/0815* (2013.01); *H05B 33/0824* (2013.01)

(58) Field of Classification Search
CPC ..... G09G 3/3406; H05B 33/0815; H05B 33/0824
USPC ..... 315/169.1–169.4, 224; 345/102, 212, 345/690; 349/61, 69; 362/97.1–97.3
See application file for complete search history.

(56) References Cited

U.S. PATENT DOCUMENTS 7,663,598 B2 * 2/2010 Kim ..... 345/102
8,030,857 B2 * 10/2011 Kita ..... 315/307
2006/0290298 A1 12/2006 Kang et al.
2007/0159750 A1 * 7/2007 Peker ..... H05B 33/0869 361/93.1
2008/0093997 A1 * 4/2008 Chen ..... H05B 33/0815 315/224
2009/0102399 A1 4/2009 Kita
2009/0167197 A1 7/2009 Wang et al.

FOREIGN PATENT DOCUMENTS

CN 1885376 A 12/2006
CN 101170850 A 4/2008
CN 101222805 A 7/2008

(Continued)

OTHER PUBLICATIONS

Office Action issued in related Chinese Patent Application No. 201010230360.2 dated Dec. 28, 2012.

(Continued)

*Primary Examiner* — Amr Awad
*Assistant Examiner* — Aaron Midkiff
(74) *Attorney, Agent, or Firm* — Morgan, Lewis & Bockius LLP

(57) ABSTRACT

A backlight unit, a method for driving the same, and a liquid crystal display device using the same are disclosed, in which a feedback voltage received in a controller to adjust a driving voltage to be supplied to a light-emitting diode string is smaller than a difference between the driving voltage and a string voltage, the backlight unit comprising a driving-voltage supplier; an LED string for receiving a driving voltage from the driving-voltage supplier, and generating a voltage drop corresponding to a string voltage; a feedback voltage generator for generating a first feedback voltage whose value is smaller than a difference between the driving voltage and the string voltage; and a controller for supplying a control signal to control the driving-voltage supplier based on the first feedback voltage.

9 Claims, 3 Drawing Sheets

(56) References Cited

FOREIGN PATENT DOCUMENTS

| | | | |
|---|---|---|---|
| CN | 101312001 | A | 11/2008 |
| CN | 101436386 | A | 5/2009 |
| KR | 10-2006-0097378 | A | 9/2006 |

OTHER PUBLICATIONS

SIPO: Second Office Action for Chinese Patent Application No. 201010230360.2—Issued on Sep. 10, 2013—Including English Translation.

* cited by examiner

BACKLIGHT UNIT, METHOD FOR DRIVING THE SAME, AND LIQUID CRYSTAL DISPLAY DEVICE USING THE SAME

CROSS REFERENCE TO RELATED APPLICATIONS

This application claims the benefit of the Korean Patent Application No. 10-2009-0131952 filed on Dec. 28, 2009, which is hereby incorporated by reference as if fully set forth herein.

BACKGROUND OF THE INVENTION

1. Field of the Invention

The present invention relates to a backlight unit, a method for driving the same, and a liquid crystal display device using the same; and more particularly, to a backlight unit, in which a feedback voltage received in a controller to adjust a driving voltage to be supplied to a light-emitting diode string is smaller than a difference between the driving voltage and a string voltage, a method for driving the same, and a liquid crystal display device using the same.

2. Discussion of the Related Art

A backlight unit is used as an illuminating device for a display panel. The backlight unit according to the related art uses a light source of cold cathode fluorescent lamp (CCFL). However, the CCFL using mercury therein may cause the environmental contamination. In addition, the CCFL has problems such as low response speed of 15 ms, and low color-realization. In detail, a color-realization ratio of CCFL is lowered by 75% as compared to the color-realization ratio of NTSC. Due to the aforementioned problems of the CCFL, a light-emitting diode (LED) has attracted great attentions as the light source for the backlight unit.

In comparison to the CCFL, the LED is environmentally-friendly, and enables a rapid response by realizing a response speed of several nano-seconds. Also, the LED can be driven by an impulse, and the LED can obtain the color-realization ratio of 80~100%. Also, if using the LED as the light source for the backlight unit, luminance and color temperature of the backlight unit can be controlled by adjusting light-radiation intensity of the LED.

In the backlight unit using the LED, there are plural LED strings, wherein each LED string includes the plural LEDs electrically connected in series.

FIG. 1 is a circuit diagram illustrating a backlight unit according to the related art.

Referring to FIG. 1, the backlight unit according to the related art includes a driving-voltage supplier 10, an LED string 20, a controller 30, a switching device (Q), and a resistor (Rs).

The driving-voltage supplier 10 generates a driving voltage (Vd) for driving the LED string 20 through the use of input voltage (Vin) supplied from the external under the control of the controller 30; and supplies the generated driving voltage (Vd) to the LED string 20.

For convenience of explanation, FIG. 1 shows only one LED string 20. However, the virtual backlight unit is provided with the plural LED strings which are driven in the same method. The plural LED strings are electrically connected in parallel to an output terminal of the driving-voltage supplier 10.

The LED string 20 includes plural LEDs electrically connected in series between the output terminal of the driving-voltage supplier 10 and the switching device (Q). Each of the plural LEDs is driven by the driving voltage (Vd) supplied from the output terminal of the driving-voltage supplier 10, to thereby emit the light. In this case, as a driving current (Ist) flows in the LED string 20, a voltage drop corresponding to a string voltage (Vst) occurs.

The controller 30 receives a first feedback voltage (Vfb1) from a first node (N1), wherein the feedback voltage (Vfb1) corresponds to a difference between the driving voltage (Vd) and the string voltage (Vst); and adjusts the driving voltage (Vd) by controlling the driving-voltage supplier 10 based on the first feedback voltage (Vfb1).

For example, if the first feedback voltage (Vfb1) is higher than a reference voltage, the controller 30 lowers a voltage value of the driving voltage (Vd) outputted from the driving-voltage supplier 10. Meanwhile, if the first feedback voltage (Vfb1) is lower than the reference voltage, the controller 30 raises the voltage value of the driving voltage (Vd) outputted from the driving-voltage supplier 10. Accordingly, the controller 30 can supply the constant driving voltage (Vd) to the LED string 20.

The controller 30 receives a second feedback voltage (Vfb2) from a second node (N2), wherein the second feedback voltage (Vfb2) corresponds to a voltage drop occurring when the driving current (Ist) flows in the resistor (Rs); and adjusts an amount of the driving current (Ist) flowing in the LED string 20 by controlling the switching device (Q) based on the second feedback voltage (Vfb2).

In the aforementioned backlight unit according to the related art, the first feedback voltage (Vfb1) received in the controller 30 to adjust the driving voltage (Vd) to be supplied to the LED string 20 is the same as the difference between the driving voltage (Vd) and the string voltage (Vst). That is, the first feedback voltage (Vfb1) can be measured by the following equation 1.

$$Vfb1 = Vd - Vst, \quad \text{[Equation 1]}$$

wherein 'Vfb1' indicates the first feedback voltage; 'Vd' indicates the driving voltage; and 'Vst' indicates the string voltage.

A manufacturing cost and unit cost of the controller 30 is increased in proportion to a permissible voltage range, that is, the voltage value of the first feedback voltage.

SUMMARY OF THE INVENTION

Accordingly, the present invention is directed to a backlight unit, a method for driving the same, and a liquid crystal display device using the same that substantially obviates one or more problems due to limitations and disadvantages of the related art.

An advantage of the present invention is to provide a backlight unit in which a feedback voltage received in a controller to adjust a driving voltage to be supplied to an LED string is smaller than a difference between the driving voltage and a string voltage.

Another advantage of the present invention is to provide a liquid crystal display device using a backlight unit in which a feedback voltage received in a controller to adjust a driving voltage to be supplied to an LED string is smaller than a difference between the driving voltage and a string voltage.

Another advantage of the present invention is to provide a method for driving a backlight unit which adjusts a driving voltage by a feedback voltage whose value is smaller than a difference between a string voltage and the driving voltage to be supplied to an LED string.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a backlight unit comprising: a driving-voltage supplier; an LED string for receiving a driving voltage from the driving-voltage supplier, and generating a voltage drop corresponding to a string voltage; a feedback voltage generator for generating a first feedback voltage whose value is smaller than a difference between the driving voltage and the string voltage; and a controller for supplying a control signal to control the driving-voltage supplier based on the first feedback voltage.

In another aspect of the present invention, there is provided a liquid crystal display device including the above backlight unit In another aspect of the present invention, there is provided a method for driving a backlight unit comprising: supplying a driving voltage to an LED string; generating a voltage drop corresponding to a string voltage through the LED string; generating a first feedback voltage whose value is smaller than a difference between the driving voltage and the string voltage; and adjusting the driving voltage supplied to the LED string based on the first feedback voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, a backlight unit according to the present invention, a method for driving the same, and a liquid crystal display device using the same will be described with reference to the accompanying drawings.

Figure 2:
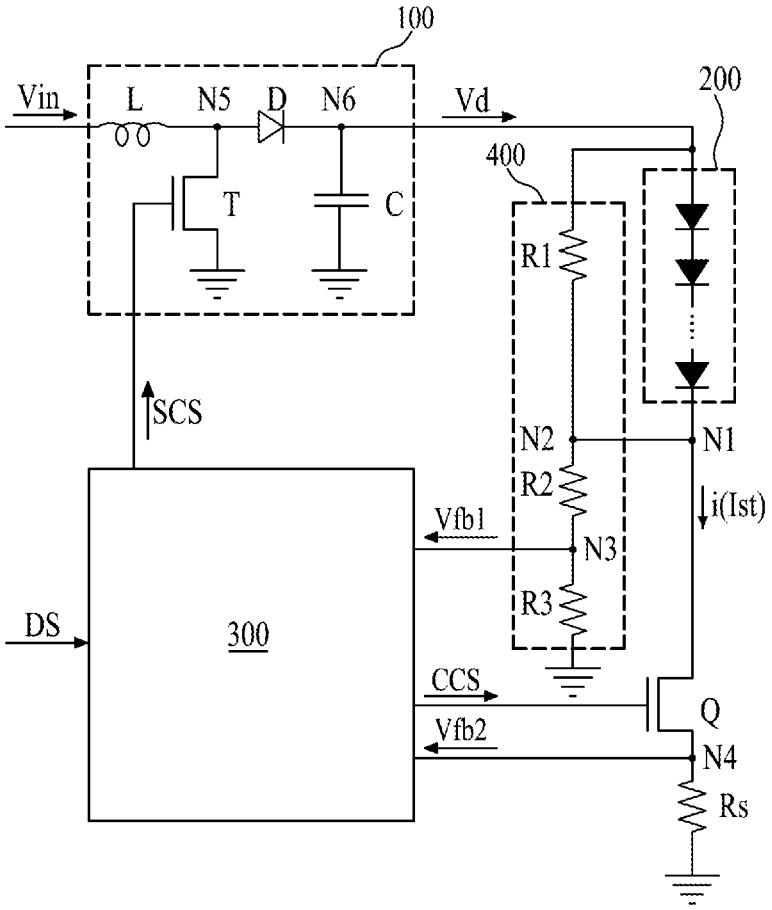
FIG. 2 is a circuit diagram illustrating a backlight unit according to one embodiment of the present invention.

FIG. 2 is a circuit diagram illustrating a backlight unit according to one embodiment of the present invention.

As shown in FIG. 2, the backlight unit according to one embodiment of the present invention includes a driving-voltage supplier 100, a light-emitting diode string 200 (hereinafter, referred to as 'LED string'), a controller 300, a feedback voltage generator 400, a switching device (Q), and a resistor (Rs).

For convenience of explanation, FIG. 2 shows only one LED string 200. Virtually, there are plural LED strings which are driven in the same driving method. Although not shown, the plural LED strings are electrically connected in parallel to an output terminal of the driving-voltage supplier 100.

For convenience of explanation, FIG. 2 shows one feedback voltage generator 400, one switching device (Q), and one resistor (Rs). Virtually, the backlight unit according to the present invention includes the plural feedback voltage generators, the plural switching devices, and the resistors, which are respectively provided for the LED strings.

The driving-voltage supplier 100 according to the present invention generates a driving voltage (Vd) for driving the LED string 200 through the use of input voltage (Vin) supplied from the external under the control of the controller 300; and supplies the generated driving voltage (Vd) to the LED string 200.

For this, the driving-voltage supplier 100 includes an input-voltage receiving unit, a driving-voltage output unit, and an input-voltage converting unit, wherein the input-voltage converting unit is provided between the input-voltage receiving unit and the driving-voltage output unit.

The input-voltage converting unit includes an inductor (L), a transistor (T), and a diode (D). The inductor (L) is positioned between the input-voltage receiving unit and a fifth node (N5); and the diode (D) is positioned between the fifth node (N5) and the driving-voltage output unit. The transistor (T) includes a gate electrode, a source electrode, and a drain electrode, wherein the gate electrode receives a control signal from the controller 300; the source electrode is connected to the fifth node (N5); and the drain electrode is connected to the ground.

The inductor (L), transistor (T), and diode (D) are driven in a power conversion circuit, which convert (DC-DC converting) the input voltage (Vin) to the driving voltage (Vd), and outputs the driving voltage (Vd). According as a switching speed of the transistor (T) is controlled based on a switching control signal (SCS) supplied from the controller 300, it is possible to properly control the conversion from the input voltage (Vin) to the driving voltage (Vd).

The driving-voltage supplier 100 further includes a capacitor (C) with first and second electrodes. The first electrode is connected to a sixth node (N6) positioned between the diode (D) and the driving-voltage output unit; and the second electrode is connected to the ground. The capacitor (C) smoothes the driving voltage (Vd) outputted from the input-voltage converting unit to a direct-current (DC) voltage.

The LED string 200 includes plural LEDs which are electrically connected in series between the output terminal of the driving-voltage supplier 100 and the switching device (Q). The plural LEDs are driven in response to the driving voltage (Vd) supplied from the driving-voltage supplier 100, to thereby emit the light. In this case, according as a driving current (Ist) flows in the LED string 200, a voltage drop corresponding to a string voltage (Vst) occurs.

The feedback voltage generator 400 generates a first feedback voltage (Vfb1) whose value is smaller than a difference value between the driving voltage (Vd) supplied to the LED string 200 and the string voltage (Vst) corresponding to the voltage drop in the LED string 200; and supplies the generated first feedback voltage (Vfb1) to the controller 30.

Owing to the feedback voltage generator 400 according to the present invention, the value of the first feedback voltage (Vfb1), which is received in the controller 300 to adjust the driving voltage (Vd) to be supplied to the LED string 200, is smaller than the difference value between the driving voltage (Vd) and the string voltage (Vst), whereby a driving IC with a small range of permissible voltage can be used for the controller 300. As a result, it is possible to reduce a manufacturing cost and unit cost of the controller 30, whereby a manufacturing cost of the backlight unit is reduced, and further a manufacturing cost of the liquid crystal display device using the backlight unit is also reduced.

The feedback voltage generator 400 according to one embodiment of the present invention will be described in detail. As shown in FIG. 2, the feedback voltage generator 400 includes first to third resistors (R1, R2, R3).

The first resistor (R1) is positioned between the driving-voltage supplier 100 and a first node (N1), wherein the first resistor (R1) is connected in parallel to the LED string 200. Since the LED string 200 and the first resistor (R1) are connected in parallel, a voltage drop in the first resistor (R1) is identical in value to the string voltage (Vst) corresponding to the voltage drop in the LED string 200.

The second resistor (R2) is positioned between a second node (N2) and the ground, and is electrically connected to the second node (N2) and the ground. The second node (N2) is positioned between the first resistor (R1) and the first node (N1), and is electrically connected to the first resistor (R1) and the first node (N1).

The third resistor (R3) is positioned between the second resistor (R2) and the ground, and is electrically connected to the second resistor (R2) and the ground.

The controller 300 receives the first feedback voltage (Vfb1) from a third node (N3) between the second and third resistors R2 and R3, wherein the first feedback voltage (Vfb1) can be measured by the following equation 2.

$$Vfb1=Vd-Vst-VR2=VR3, \quad \text{[Equation 2]}$$

wherein 'Vfb1' indicates the first feedback voltage; 'Vd' indicates the driving voltage; 'Vst' indicates the string voltage; 'VR2' indicates the voltage drop occurring in the second resistor; and 'VR3' indicates the voltage drip occurring in the third resistor.

According to one embodiment of the present invention, as shown in FIG. 2, in addition to the voltage drop corresponding to the string voltage (Vst), there is an additional voltage drop through the second resistor (R2), whereby the first feedback voltage (Vfb1) is generated. Accordingly, the first feedback voltage (Vfb1) received in the controller 300 is smaller than the difference between the driving voltage (Vd) and the string voltage (Vst) by the voltage drop occurring in the second resistor (R2).

If there is a shortage in the LED string 200, the string voltage (Vst) is 0V; and the driving voltage (Vd) is distributed by the second and third resistors (R2, R3). In this case, the first feedback voltage (Vfb1) supplied to the controller 300 can be measured by the following equation 3.

$$Vfb1=V\cdot[R3/(R2+R3)] \quad \text{[Equation 3]}$$

wherein 'Vfb1' indicates the first feedback voltage; 'Vd' indicates the driving voltage; 'R2' indicates the second resistor; and 'R3' indicates the third resistor.

The aforementioned explanation shows one exemplary case that the shortage occurs in the entire LED string 200. However, even when the shortage occurs in any one or more of the plural LEDs included in the LED string 200, the driving voltage (Vd) is distributed by the second and third resistors (R2, R3), whereby the spirit of the present invention can be identically applied.

Basically, the controller 300 according to the present invention controls the driving-voltage supplier 100 and the switching device (Q) according to a dimming signal (DS) supplied from the external.

Also, the controller 300 according to the present invention receives the first feedback voltage (Vfb1) from the feedback voltage generator 400; and controls the driving-voltage supplier 100 based on the received first feedback voltage (Vfb1), to thereby adjust the driving voltage (Vd) to be supplied to the LED string 200.

In more detail, the controller 300 according to the present invention compares the first feedback voltage (Vfb1) supplied from the feedback voltage generator 400 with a first reference voltage (Vref1); generates the switching control signal (SCS) based on the comparison result; and adjusts the switching speed of the transistor (T) of the driving-voltage supplier 100.

For example, if the first feedback voltage (Vfb1) is higher than the first reference voltage (Vref1), the controller 300 according to the present invention generates the switching control signal (SCS) to lower the voltage value of the driving voltage (Vd) outputted from the driving-voltage supplier 100. Meanwhile, if the first feedback voltage (Vfb1) is lower than the first reference voltage (Vref1), the controller 300 according to the present invention generates the switching control signal (SCS) to raise the voltage value of the driving voltage (Vd) outputted from the driving-voltage supplier 100. Thus, the controller 300 according to the present invention enables to supply the constant driving voltage (Vd) to the LED string 200.

If the first feedback voltage (Vfb1) is higher than the first reference voltage (Vref1) by a predetermined value, the controller 300 generates the switching control signal (SCS) to make the driving voltage (Vd) of 0V, wherein the driving voltage (Vd) is outputted from the driving-voltage supplier 100. Thus, the transistor (T) of the driving-voltage supplier 100 is turned-on by the switching control signal (SCS). This is to prevent the driving voltage (Vd) from being applied to the LED string 200 if there is the shortage in the LED string 200.

Selectively, the controller 300 according to the present invention can directly compares the first feedback voltage with a second reference voltage (Vref2) which is relatively higher than the first reference voltage (Vref1) by the predetermined value. Based on the comparison result, if the first feedback voltage (Vref1) is higher than the second reference voltage (Vref2), the controller 300 can generate the switching control signal (SCS) to make the driving voltage (Vd) of 0V.

The controller 300 according to the present invention receives a second feedback voltage (Vfb2) from a fourth node (N4), wherein the second feedback voltage (Vfb2) corresponds a voltage drop which occurs by the flow of the driving current (Ist) in the resistor (Rs); and compares the received second feedback voltage (Vfb2) with a third reference voltage (Vref3). Based on the comparison result, the controller 300 controls the switching device (Q), to thereby adjust the amount of driving current (Ist) flowing in the LED string 200.

That is, when the switching device (Q) is turned-on, a voltage drop above a threshold voltage (Vth) occurs in the LED string 200, wherein the threshold voltage (Vth) indicates a minimum voltage needed to drive the LEDs included in the LED string 200. Thus, the second feedback voltage (Vfb2) whose value corresponds to the difference between the driving voltage (Vd) and the string voltage (Vst) above the threshold voltage (Vth) is supplied to the controller 300.

When the switching device (Q) is turned-off, the second feedback voltage (Vfb2) supplied to the controller 300 is 0V.

The controller 300 compares the second feedback voltage (Vfb2) supplied from the fourth node (N4) with the third reference voltage (Vref3) through the use of comparator (not shown). Based on the comparison result, the controller 300 generates a current control signal (CCS) to control the switching device (Q).

That is, if the second feedback voltage (Vfb2) is higher than the third reference voltage (Vref3), the controller 300 generates the current control signal (CCS) to reduce the amount of driving current (Ist) flowing in the LED string 200. Meanwhile, if the second feedback voltage (Vfb2) is lower than the third reference voltage (Vref3), the controller 300 generates the current control signal (CCS) to increase the amount of driving current (Ist). As a result, the controller 300 can constantly maintain the amount of driving current (Ist) flowing in the LED string 200. The controller 300 generates and uses the first, second, and third reference voltages Vref1, Vref2, Vref3 internally for the purposes of the above-described comparisons.

Hereinafter, a method for driving the backlight unit according to the present invention will be described with reference to FIG. 3.

Figure 3:
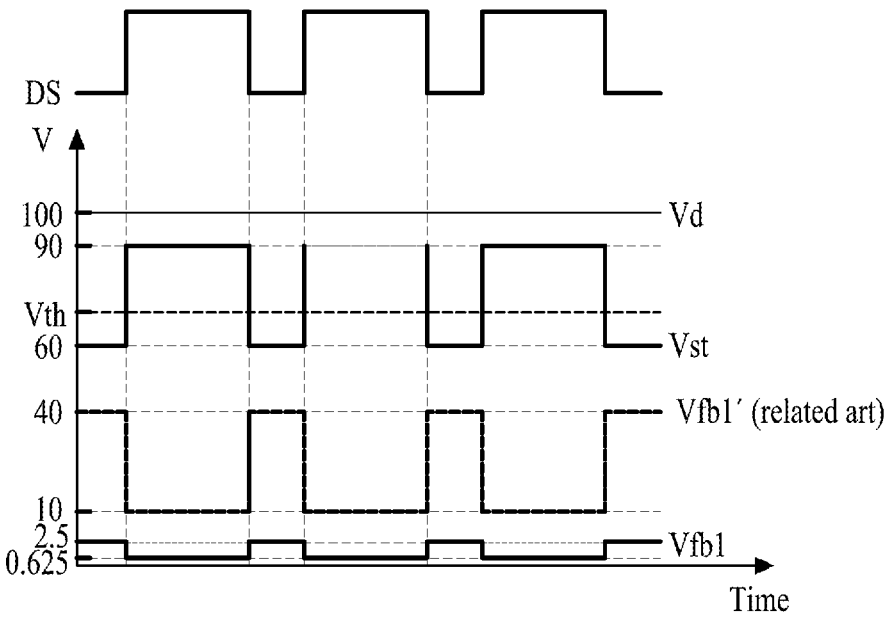
FIG. 3 is a waveform diagram illustrating a backlight unit according to one embodiment of the present invention.

FIG. 3 is a waveform diagram illustrating a method for driving the backlight unit according to one embodiment of the present invention.

For example, supposing that the driving voltage (Vd) supplied from the driving-voltage supplier 100 is constantly maintained at 100V; resistance values of the respective first, second and third resistors (R1, R2, R3) are 600 kΩ, 375 kΩ, and 25 kΩ; and the second reference voltage (Vref2) to be compared with the first feedback voltage (Vfb1) so as to check the shortage of the LED string 200 is 3V.

On assumption that the LED string 200 has no problems, a driving method of the LED string 200 will be explained as follows.

For example, when the switching device (Q) is turned-on, the string voltage (Vst) corresponding to the voltage drop in the LED string 200 is 90V, which is higher than the threshold voltage (Vth) for the light emission; the first feedback voltage (Vfb1) is 0.625V; and the second feedback voltage (Vfb2) is 10V.

Figure 1:
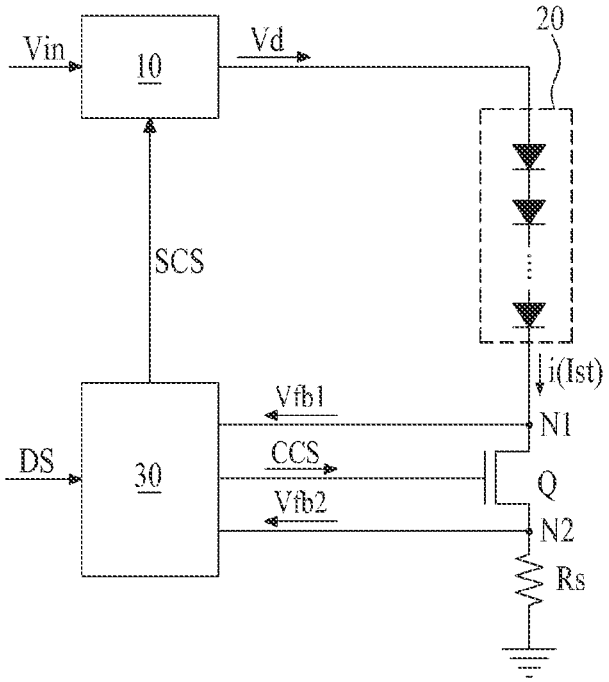
FIG.1 (Related Art)
FIG. 1 is a circuit diagram illustrating a backlight unit according to the related art.

In case of the related art backlight unit without the feedback voltage generator, as shown in FIG. 1, the first feedback voltage (Vfb1') is 10V when the switching device (Q) is turned-on. That is, it is known that the first feedback voltage (Vfb1') of the related art is considerably higher in comparison to 0.625V corresponding to the first feedback voltage (Vfb1) of the present invention.

When the switching device (Q) is turned-off, the string voltage (Vst) corresponding to the voltage drop in the LED string 200 is 60V, which is lower than the threshold voltage (Vth) for the light emission; the first feedback voltage (Vfb1) is 2.5V; and the second feedback voltage (Vfb2) is 0V.

In case of the related art backlight unit without the feedback voltage generator, as shown in FIG. 1, the first feedback voltage (Vfb1') is 40V when the switching device (Q) is turned-off. That is, the first feedback voltage (Vfb1') of the related art is considerably higher in comparison to 2.5V corresponding to the first feedback voltage (Vfb1) of the present invention.

Regardless of whether or not the switching device (Q) is turned-on, the first feedback voltage (Vfb1) is less than 3V corresponding to the second reference voltage (Vref2), whereby the controller 300 can control the driving-voltage supplier 100 in a normal method.

However, in case of the related art backlight unit without the feedback voltage generator, as shown in FIG. 1, the first feedback voltage (Vfb1') of 10V or 40V is supplied to the controller 300. Thus, the second reference voltage (Vref2) has to be 40V or higher than 40V, whereby the controller 30 has to be necessarily formed of an expensive driving IC with a large range of permissible voltage.

On assumption that the LED string 200 has the shortage problem, a driving method of the LED string 200 will be explained as follows.

If there is the shortage in the LED string 200, the current excessively flows in the LED string 200, regardless of whether or not the switching device (Q) is turned-on. Thus, the string voltage (Vst) is 0V; and the first feedback voltage (Vfb1) is 6.25V. That is, the first feedback voltage (Vfb1) of 6.25V is supplied to the controller 300.

The first feedback voltage (Vfb1) of 6.25V is higher than the second reference voltage (Vref2) of 3V, whereby the controller 300 generates the switching control signal (SCS) to make the driving voltage (Vd) of 0V, and transmits the generated switching control signal (SCS) to the driving-voltage supplier 200. Meanwhile, the second feedback voltage (Vfb2) is 100V when the switching device (Q) is turned-on; and the second feedback voltage (Vfb2) is 0V when the switching device (Q) is turned-off.

In case of the related art backlight unit without the feedback voltage generator, as shown in FIG. 1, the first feedback voltage (Vfb1') is 100V when there is the shortage in the LED string 200.

Then, the liquid crystal display device can be manufactured by combining the backlight unit according to the present invention with a liquid crystal display panel. In this case, the liquid crystal display panel includes a TFT substrate, a liquid crystal layer, and an upper substrate which are deposited in sequence. In addition, there may be plural optical sheets in the liquid crystal display panel.

In the backlight unit according to the present invention, the feedback voltage received in the controller 300 to adjust the driving voltage (Vd) to be supplied to the LED string 200 is smaller than the difference between the driving voltage (Vd) and the string voltage (Vst), whereby the driving IC with the small range of permissible voltage can be used for the controller 300. As a result, it is possible to reduce the manufacturing cost and unit cost of the controller 300, whereby the manufacturing cost of the backlight unit is reduced, and further the manufacturing cost of the liquid crystal display device using the backlight unit is also reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A backlight unit, comprising:

a driving-voltage supplier;

an LED string configured to:

receive a driving voltage from the driving-voltage supplier; and generate a voltage drop corresponding to a string voltage;

a feedback voltage generator configured to generate a first feedback voltage whose value is smaller than a difference between the driving voltage and the string voltage; and a controller configured to:

generate at least first, second, and third reference voltages, each of which having a different value;

supply a control signal to control the driving-voltage supplier based on the first feedback voltage;

in response to the first feedback voltage being higher than the second reference voltage, generate a control signal that allows a driving voltage to become 0 V; and in response to a second feedback voltage being higher than the third reference voltage, generate a control signal to reduce an amount of driving current flowing in the LED string, wherein the second feedback voltage is different from the first feedback voltage, and wherein:

the LED string is positioned between the driving-voltage supplier and a first node, the feedback voltage generator comprises:

a first resistor positioned between the driving-voltage supplier and the first node, and connected in parallel to the LED string;

a second resistor positioned between a second node and ground, the second node being positioned between the first resistor and the first node; and a third resistor positioned between the second resistor and the ground, and the controller is further configured to receive the first feedback voltage from a third node positioned between the second and third resistors.

2. The backlight unit according to claim 1, further comprising:

a switching device between the first node and a fourth node; and a fourth resistor between the fourth node and the ground, wherein the controller is further configured to:

receive the second feedback voltage from the fourth node, and control the switching device based on the second feedback voltage.

3. The backlight unit according to claim 2, wherein the driving-voltage supplier includes an input-voltage receiving unit, a driving-voltage outputting unit, and an input-voltage converting unit positioned between the input-voltage receiving unit and the driving-voltage outputting unit.

4. The backlight unit according to claim 3, wherein:

the input-voltage converting unit includes an inductor, a transistor, and a diode;

the inductor is positioned between the input-voltage receiving unit and a fifth node;

the diode is positioned between the fifth node and the driving-voltage outputting unit; and the transistor includes:

a gate electrode configured to receive a control signal from the controller;

a source electrode connected to the fifth node; and a drain electrode connected to the ground.

5. The backlight unit according to claim 4, wherein:

the driving-voltage supplier further includes a capacitor with first and second electrodes;

the first electrode of the capacitor is connected to a sixth node positioned between the diode and the driving-voltage outputting unit; and the second electrode of the capacitor is connected to the ground.

6. A liquid crystal display device including a backlight unit of any one of claims 1, 2 to 5.

7. A method for driving a backlight unit, the method comprising:

supplying a driving voltage to an LED string;

generating a voltage drop corresponding to a string voltage through the LED string;

generating a first feedback voltage whose value is smaller than a difference between the driving voltage and the string voltage;

generating at least first, second, and third reference voltages, each of which having a different value;

adjusting the driving voltage supplied to the LED string based on the first feedback voltage;

in response to the first feedback voltage being higher than the second reference voltage, generating a control signal that allows a driving voltage to become 0 V; and in response to a second feedback voltage being higher than the third reference voltage, generating a control signal to reduce an amount of driving current flowing in the LED string, wherein the second feedback voltage is different from the first feedback voltage, and wherein:

the LED string is positioned between the driving-voltage supplier and a first node, the feedback voltage generator comprises:

a first resistor positioned between the driving-voltage supplier and the first node, and connected in parallel to the LED string;

a second resistor positioned between a second node and ground, the second node being positioned between the first resistor and the first node; and a third resistor positioned between the second resistor and the ground, and the controller receives the first feedback voltage from a third node positioned between the second and third resistors.

8. The method according to claim 7, wherein generating the first feedback voltage comprises generating an additional voltage drop through a resistor, after generating the voltage drop corresponding to the string voltage.

9. The method according to claim 7, further comprising:

generating the second feedback voltage to have a value identical to the difference between the driving voltage and the string voltage; and adjusting the amount of driving current flowing in the LED string based on the second feedback voltage.

* * * * *